US012630980B2

(12) United States Patent
Sawada et al.

(10) Patent No.: US 12,630,980 B2
(45) Date of Patent: May 19, 2026

(54) WET CELLULOSE FIBER SHEET AND METHOD FOR PRODUCING CELLULOSE FIBER MOLDED BODY

(71) Applicant: DAIO PAPER CORPORATION, Ehime (JP)

(72) Inventors: Kazuto Sawada, Aichi (JP); Masashi Uno, Ehime (JP); Kazuo Fujita, Ehime (JP); Takahiro Miyoshi, Ehime (JP); Takaaki Imai, Ehime (JP)

(73) Assignee: Daio Paper Corporation, Ehime (JP)

( * ) Notice: Subject to any disclaimer, the term of this patent is extended or adjusted under 35 U.S.C. 154(b) by 343 days.

(21) Appl. No.: 18/038,119

(22) PCT Filed: Dec. 1, 2021

(86) PCT No.: PCT/JP2021/044065

§ 371 (c)(1),
(2) Date: May 22, 2023

(87) PCT Pub. No.: WO2022/118875

PCT Pub. Date: Jun. 9, 2022

(65) Prior Publication Data

US 2024/0003095 A1 Jan. 4, 2024

(30) Foreign Application Priority Data

Dec. 2, 2020 (JP) ..... 2020-200476

(51) Int. Cl.
*D21J 3/12* (2006.01)
*D21H 11/18* (2006.01)

(52) U.S. Cl.
CPC ..... *D21J 3/12* (2013.01); *D21H 11/18* (2013.01)

(58) Field of Classification Search
CPC ... D21J 3/12; D21J 3/00; D21H 11/18; D21H 15/02
See application file for complete search history.

(56) References Cited

U.S. PATENT DOCUMENTS 11,814,794 B2 * 11/2023 Imai ..... D21J 3/12
11,879,213 B2 * 1/2024 Pereira Maia ..... D21H 11/18
(Continued)

FOREIGN PATENT DOCUMENTS

CN 116457531 A * 7/2023 ..... D21H 15/02
EP 2781652 A1 * 9/2014 ..... D04H 1/425
(Continued)

OTHER PUBLICATIONS

Masao et al., Machinte Translation of JP 2019183350 A. (Year: 2019).*

(Continued)

*Primary Examiner* — Jose A Fortuna
(74) *Attorney, Agent, or Firm* — Andrus Intellectual Property Law, LLP

(57) ABSTRACT

A wet sheet which is hard to be fractured during production into a molded body, stable in shape, and easy to handle in processing, and a method for producing a molded body from the wet sheet. The wet sheet includes fine cellulose fibers having an average fiber diameter of 10000 nm or smaller, and pulp, wherein the wet sheet has a water content of 60 mass % or higher, and a thickness of 0.5 mm or more and 10 mm or less. A method for producing a molded body includes applying heat and pressure to a wet sheet to obtain a molded body, wherein the wet sheet includes fine cellulose fibers having an average fiber diameter of 10000 nm or smaller, and pulp, and has a water content of 60 mass % or higher, and a thickness of 0.5 mm or more and 10 mm or less.

3 Claims, 2 Drawing Sheets

(56) References Cited

U.S. PATENT DOCUMENTS

| | | | | |
|---|---|---|---|---|
| 12,000,088 | B2 * | 6/2024 | Sealey, II | D21F 9/00 |
| 12,163,287 | B2 * | 12/2024 | Uchimura | D01F 2/00 |
| 2017/0314201 | A1 | 11/2017 | Hikida | |
| 2019/0047273 | A1 | 2/2019 | Heiskanen et al. | |
| 2022/0064858 | A1 * | 3/2022 | Imai | D21J 5/00 |
| 2024/0003095 | A1 * | 1/2024 | Sawada | D21H 15/02 |

FOREIGN PATENT DOCUMENTS

| | | | | |
|---|---|---|---|---|
| EP | 2781652 | B2 * | 9/2018 | D21H 17/25 |
| EP | 4257745 | A1 * | 10/2023 | D21H 15/02 |
| JP | 2012-111063 | | 6/2012 | |
| JP | 2016-094683 | | 5/2016 | |
| JP | 2019-199671 | | 5/2016 | |
| JP | 2018062718 | A | 4/2018 | |
| JP | 2018062727 | A | 4/2018 | |
| JP | 2018-534393 | | 11/2018 | |
| JP | 2018199872 | A | 12/2018 | |
| JP | 2019-183320 | A | 10/2019 | |
| JP | 2019-183350 | | 10/2019 | |
| JP | 2019199671 | A | 11/2019 | |
| JP | 2020-059962 | | 4/2020 | |
| JP | 2020059933 | A * | 4/2020 | |
| JP | 2020059962 | A * | 4/2020 | |
| JP | 7608134 | B2 * | 1/2025 | D21H 11/18 |
| KR | 102842994 | B1 * | 8/2025 | C08B 1/003 |
| TW | 202140274 | A * | 11/2021 | B32B 27/12 |
| WO | 2020/071120 | | 4/2020 | |
| WO | WO-2020165780 | A1 * | 8/2020 | D21H 27/10 |
| WO | WO-2022118875 | A1 * | 6/2022 | D21H 15/02 |

OTHER PUBLICATIONS

Junya et bal., machine Translation of JP 2018062718 A. (Year: 2018).*

Office Action for CN Patent Appl. No. 202180074942.2, dated Mar. 8, 2025.

International Search Report and Written Opinion for PCT/JP2021/044065, dated Feb. 1, 2022.

Extended European Search Report for European Patent Application No. 21900626.9, dated Sep. 27, 2024.

* cited by examiner

[FIG.1]
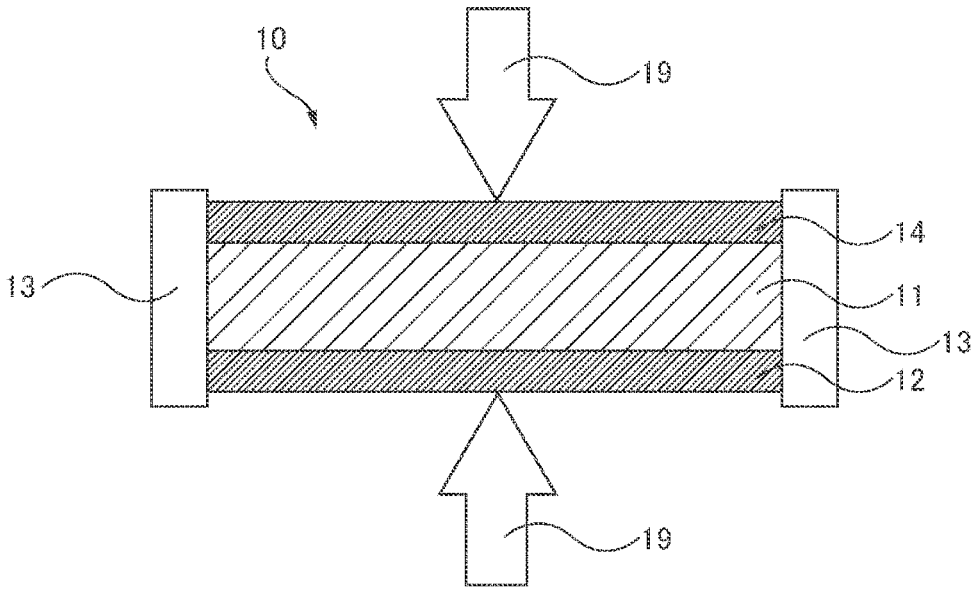

[FIG.2]
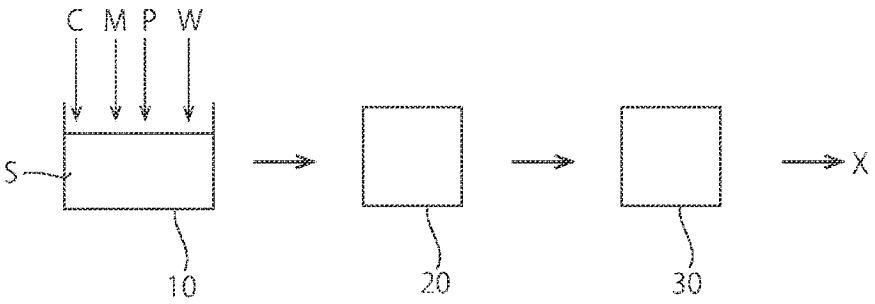

WET CELLULOSE FIBER SHEET AND METHOD FOR PRODUCING CELLULOSE FIBER MOLDED BODY

CROSS-REFERENCE TO RELATED APPLICATIONS

This application is the U.S. national stage application of International Application PCT/JP2021/044065, filed Dec. 1, 2021, which international application was published on Jun. 9, 2022, as International Publication WO 2022/118875 in the Japanese language. The International Application claims priority of Japanese Patent Application No. P2020-200476, filed Dec. 2, 2020. The international application and Japanese application are both incorporated herein by reference, in entirety.

FIELD OF ART

The present invention relates to a wet cellulose fiber sheet and a method for producing a cellulose fiber molded body.

BACKGROUND ART

Nanotechnology, which aims to obtain new properties of a simple substance different from its inherent properties by making the substance finer to the nano-revel, has recently been attracting attention. This nanotechnology is applied to cellulose-based raw materials, and fine cellulose fibers obtained by defibration of pulp into the nano level through chemical treatment, grinding, and the like processes, have excellent strength, elasticity, and the like, and are expected to be used in various applications. In particular, molded bodies produced by preparing a slurry of fine cellulose fibers, followed by drying and shaping the same, have high strength, are recyclable organic resources, and thus useful as a material with broad utility. For example, JP 2016-094683 (Patent Publication 1) proposes "a method for molding CNFs, which includes filling a mold form having a vapor-permeable means with a CNF (cellulose nanofiber)-containing slurry, and applying a load to the CNF-containing slurry in conjunction with condensation of the CNF-containing slurry". This publication discloses that "it is an object of the disclosure to provide a method for molding CNFs in which drying conditions are controlled with ease and which enables a CNF molded product to be obtained at a high productivity that is substantially free from shrinkage or crazing and has a stable sophisticated three dimensional configuration, and the CNF molded product obtained by the method for molding CNFs".

However, in manufacturing a molded product having a three dimensional configuration by the method of this publication, in drying the slurry, difference in thickness of the molded product from area to area may lead to ununiform application of load, and may cause difference in degree of drying from area to area, which may result in fracture. Further, the slurry is instable in shape and is thus not easy to handle.

PRIOR ART PUBLICATION

Patent Publication

Patent Publication 1: JP 2016-094683 A

SUMMARY OF THE INVENTION

Problems to be Solved by the Invention

It is therefore a primary object of the present invention to provide a wet sheet which is hard to fracture during manufacturing into a molded body, stable in shape, and easy to handle in processing, and a method for producing a molded body from the wet sheet.

Means for Solving the Problems

Slurry contains a large amount of water and is thus hard to retain its shape. For drying such a slurry, JP 2016-094683 (Patent Publication 1) employs a technique wherein the slurry is placed on a porous body, covered with another porous body on its upper part, and pressed and squeezed with these two porous bodies to dry. By this technique, pressure application to the slurry in the direction of gravitational force results in a molded body with less variation in thickness, but pressure application in the direction other than the direction of gravitational force causes unevenness in slurry concentration due to its own weight, resulting in a molded body with not a little variation in thickness. Further, when a slurry with uneven concentration is dried, fracture may result due to difference in shrinkage.

The present inventors have made intensive researches to find out that, for shaping a body that is hardly fractured, the raw material for the molded body is preferably in the form of a sheet. With the raw material in the form of a sheet, a molded body which is hard to fracture may be obtained, as the uneven concentration as in a slurry hardly occurs and the shrinkage may hardly vary depending on the direction of pressure application. The aspects of the invention that solve the above problems in view of these are as follows.

<First Aspect>

A wet sheet including:

fine cellulose fibers having an average fiber diameter of 10000 nm or smaller, and pulp, wherein the wet sheet has a water content of 60 mass % or higher, and a thickness of 0.5 mm or more and 10 mm or less.

A wet sheet composed solely of fine cellulose fibers may not produce a molded body with sufficient dewaterability. However, a wet sheet containing pulp and fine cellulose fibers produces a molded body with sufficient dewaterability. Further, the wet sheet has a shape, a water content of 60 mass % or higher, and a thickness within the above-mentioned range, so that it is easily deformed and processed into a stable shape. Further, the constituent pulp and the fine cellulose fibers are not free to move and are fixed in the wet sheet, unlike in a slurry. Moreover, the wet sheet is hard to be fractured due to fluidization of slurry during manufacture of a molded body, and is not relatively bulky, which leads to easy handling in processing.

<Second Aspect>

The wet sheet according to the first aspect, wherein the fine cellulose fibers are at least either of cellulose nanofibers and microfibrillated cellulose having a larger average fiber diameter than that of the cellulose nanofibers.

The fine cellulose fibers used in the wet sheet may be cellulose nanofibers, microfibrillated cellulose, or a mixture of cellulose nanofibers and microfibrillated cellulose. The wet sheet, if made only of pulp, would have insufficient water retention capacity but, containing at least one of cellulose nanofibers and microfibrillated cellulose both having excellent water retention capacity, water retention capacity is imparted to the wet sheet.

<Third Aspect>

The wet sheet according to the first or second aspect, wherein a rate of thickness change determined by formula 1 is 0.4 or lower:

Rate of thickness change=((Thickness of wet sheet after application of pressure at 100 kPa in thickness direction for 1 second)−(Thickness of wet sheet after application of pressure at 100 kPa in thickness direction for 5 seconds))/(Thickness of wet sheet after application of pressure at 100 kPa in thickness direction for 1 second). Formula 1:

In addition to the first aspect, with the rate of thickness change of 0.4 or lower, the wet sheet according to this aspect is hardly deformable in the thickness direction, and hard to be fractured by deformation in the thickness direction during processing into a molded body. Further, even when the present wet sheet, which is hardly deformable in the thickness direction, is subjected to pressure and heating, local irregularities hardly result, and homogenous molded body may be produced.

<Fourth Aspect>

The wet sheet according to any one of the first to third aspects, wherein a solid concentration of the fine cellulose fibers in the wet sheet is 10 mass % or more.

A molded body containing the fine cellulose fibers has relatively higher strength. The wet sheet according to the present aspect contains the fine cellulose fibers at the above-mentioned concentration and, accordingly may produce a molded body of sufficient strength.

<Fifth Aspect>

A method for producing a molded body, including:

applying heat and pressure to a wet sheet to obtain a molded body, wherein the wet sheet includes fine cellulose fibers having an average fiber diameter of 10000 nm or smaller, and pulp, and has a water content of 60 mass % or higher, and a thickness of 0.5 mm or more and 10 mm or less.

The pulp and the fine cellulose fibers constitute the wet sheet, and are thus not free to move in the wet sheet, unlike the materials constituting a slurry. A slurry changes its overall shape due to its own weight during processing, but the present aspect provides a wet sheet, in which the constituent pulp and fine cellulose fibers are fixed and the concentration is hardly uneven, so that fracture hardly occurs during processing and a homogeneous molded body may be obtained.

<Sixth Aspect>

A method for producing a molded body, including:

preparing a slurry by mixing fine cellulose fibers having an average fiber diameter of 10000 nm or smaller, and pulp, shaping the slurry into a wet sheet by holding the slurry between two facing net sheets and applying pressure to the slurry to dewater, and applying heat and pressure to the wet sheet to obtain a molded body, wherein the wet sheet has a water content of 60 mass % or higher, and a thickness of 0.5 mm or more and 10 mm or less.

According to the present aspect, a slurry is processed into a sheet in a processing step to produce a wet sheet. The wet sheet is in the form of a sheet, hardly deformable by its own weight, rarely lets part of the pulp or fine cellulose fibers out or lost to waste the raw materials, and is easy to handle.

<Seventh Aspect>

The method for producing a molded body according to fifth or sixth aspect, wherein the fine cellulose fibers are at least either of cellulose nanofibers and microfibrillated cellulose having a larger average fiber diameter than that of the cellulose nanofibers.

This aspect produces effects similar to those of the second aspect.

<Eighth Aspect>

The method for producing a molded body according to any one of the fifth to seventh aspects, wherein a rate of thickness change determined by formula 1 is 0.4 or lower:

Rate of thickness change=((Thickness of wet sheet after application of pressure at 100 kPa in thickness direction for 1 second)−(Thickness of wet sheet after application of pressure at 100 kPa in thickness direction for 5 seconds))/(Thickness of wet sheet after application of pressure at 100 kPa in thickness direction for 1 second). Formula 1:

This aspect produces effects similar to those of the third aspect.

<Ninth Aspect>

The method for producing a molded body according to any one of the fifth to eighth aspects, wherein a solid concentration of the fine cellulose fibers in the wet sheet is 10 mass % or more.

This aspect produces effects similar to those of the fourth aspect.

<Tenth Aspect>

The method for producing a molded body according to any one of the fifth to ninth aspects, wherein the dewatering is carried out substantially without heating.

When the wet sheet is heated to cause the water to vaporize, the water content of the wet sheet may vary locally to cause uneven water content over the wet sheet. Substantially without heating, vaporization accompanying evaporation of the water is hindered, so that the unevenness in concentration of the fine cellulose fibers may be avoided.

Effects of the Invention

According to the present invention, there are provided a wet sheet which is hard to be fractured during production into a molded body, stable in shape, and easy to handle in processing, and a method for producing a molded body from the wet sheet.

BRIEF DESCRIPTION OF THE DRAWINGS

FIG. 1 is an explanatory illustration of a method for producing the wet sheet.

FIG. 2 is an explanatory diagram of a method for producing the wet sheet and the molded body.

EMBODIMENTS FOR CARRYING OUT THE INVENTION

Next, embodiments for carrying out the present invention will now be explained. Note that these embodiments are mere examples of the present invention, and the scope of the invention is not limited to the scopes of the embodiments.

The wet sheet according to the embodiment contains fine cellulose fibers having an average fiber diameter of 10000 nm or smaller, and pulp, and has a water content of 60 mass % or higher, and a thickness of 0.5 mm or more and 10 mm or less. The fine cellulose fibers are at least either of cellulose nanofibers (sometimes abbreviated as CNF hereinbelow) and microfibrillated cellulose having a larger average diameter than that of the cellulose nanofibers (sometimes abbreviated as MFC hereinbelow). The pulp, the cellulose nanofibers, the microfibrillated cellulose, and the wet sheet will be explained below.

<Pulp>

The pulp is included in the wet sheet, and functions to improve dewaterability of the wet sheet. By adjusting the amount of the pulp contained in the wet sheet, the water content of the wet sheet may be adjusted to fall within a desired range. Further, by adjusting the proportions of the pulp and the fine cellulose fibers in the wet sheet, the strength of the resulting molded body may be adjusted to fall within a desired range.

The pulp used in the present embodiment may be one or more members selected and used from various kinds of raw material pulp for cellulose nanofibers to be discussed later. Among them, in particular, the pulp is preferably pulp containing lignin, more preferably mechanical pulp, and particularly preferably bleached thermo-mechanical pulp (BTMP). With such pulp, dewaterability of a cellulose fiber slurry is further improved. Further, it is preferred to use the pulp of the present embodiment also as the pulp for the fine cellulose fibers. With the same starting materials, the two are highly compatible and, during application of pressure to the slurry to obtain a wet sheet, outflow of the fine cellulose fibers may be controlled, dewatering is facilitated, and the time to be spent on the process may be saved.

The pulp may be unbeaten pulp or beaten pulp. With unbeaten pulp, dewaterability may be improved. With beaten pulp, entangling of the fine cellulose fibers with the pulp may be facilitated to regulate outflow of the cellulose nanofibers and microfibrillated cellulose, and a relatively larger number of hydrogen bonding points result, which may lead to enhanced strength of the resulting molded body.

The degree of beating of the pulp may be represented by freeness, and the pulp may have a freeness of, for example 200 to 800 ml, preferably 350 to 780 ml, more preferably 400 to 750 ml. With a freeness of the pulp of 800 ml, the wet sheet has improved dewaterability, but is easier to fracture during processing into a molded body. Further, the fibers of the pulp may be so rigid as to disturb integration between the pulp and the fine cellulose fibers to thereby hinder improvement in density.

On the other hand, with a freeness of the pulp below 200 ml, dewaterability of the wet sheet may not be improved sufficiently, and rigidity of the pulp fibers per se may be so low that the wet sheet cannot maintain its sheet shape.

The freeness of the pulp is determined in accordance with JIS P8121-2:2012.

The average fiber diameter of the pulp may be adjusted by selection of the kind of pulp and degree of defibration.

The average fiber diameter of the pulp (average fiber width or average diameter of single fibers) may be preferably over 10 μm and 100 μm or smaller, more preferably over 10 μm and 80 μm or smaller, particularly preferably over 10 μm and 60 μm or smaller. With the average fiber diameter of the pulp within such a range, dewaterability of the wet sheet may further be improved by adjusting the pulp content to fall within the range to be discussed later.

The average fiber diameter of the pulp may be determined by means of a fiber analyzer FS5 manufactured by Valmet K.K. The fiber analyzer FS5 is capable of measuring the length and the width of cellulose fibers with high precision, through image analysis of diluted cellulose fibers performed when passing through the measuring cells in the fiber analyzer.

With the average fiber diameters of the pulp and the fine cellulose fibers within the above-mentioned ranges, respectively, the content (solid concentration) of the pulp in the wet sheet is preferably 0.1 to 20 mass %, more preferably 0.5 to 12 mass %, particularly preferably 1.0 to 8 mass %. With the content of the pulp below 0.1 mass %, dewatering of the wet sheet may require time, which lowers productivity. With the content (solid concentration) of the pulp above 20 mass %, the relative content of the fine cellulose fibers is decreased in the production of a molded body or the like from the wet sheet, so that the strength of the molded body or the like may not be ensured.

<Cellulose Nanofibers>

The cellulose nanofibers contained in the wet sheet are discussed below. Cellulose nanofibers are regarded as having a large number of hydrogen bonding points of cellulose fibers, and having a property to disperse and form a three-dimensional network structure when mixed in a media, such as water or organic solvents. Such a three-dimensional network structure is formed by cellulose nanofibers each forming a skeleton of a three-dimensional network structure, and assumed to take, though difficult to describe, the form of a three-dimensional grid structure, like a jungle gym (the three-dimensional grids may be arranged either regularly or irregularly). The interior of the three-dimensional grids formed with the cellulose nanofibers is void.

Cellulose nanofibers may be obtained by defibrating (making finer) raw material pulp derived from plant. As the raw material pulp for cellulose nanofibers, one or more members may be selected and used from the group consisting of, for example, wood pulp made from hardwood, softwood, or the like; non-wood pulp made from straw, bagasse, cotton, hemp, bast fibers, or the like; and de-inked pulp (DIP) made from brown waste paper, envelope waste paper, magazine waste paper, leaflet waste paper, corrugated waste paper, hard white waste paper, simili waste paper, ground wood waste paper, recovered used paper, waste paper, or the like. These various raw materials may be in the form of a ground product, such as those referred to as cellulose-based powder.

In this regard, however, the raw material pulp is preferably wood pulp in order to avoid contamination of impurities as much as possible. As the wood pulp, one or more members may be selected and used from the group consisting of, for example, chemical pulp, such as hardwood kraft pulp (LKP) and softwood kraft pulp (NKP), and mechanical pulp (TMP).

The hardwood kraft pulp may be hardwood bleached kraft pulp, hardwood unbleached kraft pulp, or hardwood semi-bleached kraft pulp. Similarly, the softwood kraft pulp may be softwood bleached kraft pulp, softwood unbleached kraft pulp, or softwood semi-bleached kraft pulp.

As the mechanical pulp, one or more members may be selected and used from the group consisting of, for example, stone ground pulp (SGP), pressurized stone ground pulp (PGW), refiner ground pulp (RGP), chemi-ground pulp (CGP), thermo-ground pulp (TGP), ground pulp (GP), thermomechanical pulp (TMP), chemithermomechanical pulp (CTMP), refiner mechanical pulp (RMP), and bleached thermomechanical pulp (BTMP).

For production of the wet sheet and the molded body, preferably chemical pulp, more preferably LKP and NKP may be used for imparting a higher strength.

The raw material pulp for the cellulose nanofibers and the raw material pulp for the microfibrillated cellulose may be different, but may preferably be the same for lower costs of the raw materials.

The raw material pulp for the cellulose nanofibers may be pretreated prior to defibration. The pretreatment may be, for example, mechanical pre-beating of raw material pulp, or chemical modification of raw material pulp. The manner of pre-beating is not particularly limited, and a known technique may be employed.

Pretreatment of the raw material pulp by a chemical method may be, for example, hydrolysis of polysaccharides with acid (acid treatment), hydrolysis of polysaccharides with enzyme (enzyme treatment), swelling of polysaccharides with alkali (alkali treatment), oxidation of polysaccharides with an oxidizing agent (e.g., ozone) (oxidation treatment), reduction of polysaccharides with a reducing agent (reduction treatment), oxidation in the presence of TEMPO catalyst (oxidation treatment), anionization by phosphoesterification, carbamation, or the like (anionization treatment), or cationization (cationization treatment).

Through the alkali treatment, part of the hydroxyl groups of hemicellulose or cellulose in pulp is dissociated, resulting in anionization of the molecules. This causes the intra- and intermolecular hydrogen bonds to be weakened, allowing easy defibration to promote dispersion of cellulose fibers.

As the alkali used in the alkali treatment, for example, sodium hydroxide, lithium hydroxide, potassium hydroxide, an aqueous ammonia solution, or organic alkali, such as tetramethylammonium hydroxide, tetraethylammonium hydroxide, tetrabutylammonium hydroxide, and benzyltrimethylammonium hydroxide may be used. In view of the manufacturing cost, sodium hydroxide is preferably used.

The enzyme treatment, acid treatment, or oxidation treatment may result in a lower water retention, a higher degree of crystallinity, and also higher homogeneity of the cellulose nanofibers. In this regard, cellulose nanofibers at a lower water retention are easily dewatered, so that dewaterability of the wet sheet may be improved.

The enzyme treatment, acid treatment, or oxidation treatment of the raw material pulp causes decomposition of the amorphous region of hemicellulose and cellulose in pulp, which leads to reduction of energy required for the treatment to make the raw material pulp finer, and to improvement in uniformity and dispersibility of the fine cellulose fibers. Dispersibility of cellulose fibers serves, for example, to improve the homogeneity of the molded body in its production from a cellulose fiber slurry. However, the pretreatment reduces the average fiber diameter and thus lowers the aspect ratio of cellulose nanofibers. Accordingly, it is preferred to avoid excessive pretreatment.

Through the anionization, cellulose nanofibers are modified with anionic functional groups introduced therein. Examples of such modified cellulose nanofibers may include cellulose nanofibers esterified with phosphorus oxoacid, carbamated cellulose nanofibers, or cellulose nanofibers having hydroxyl groups in the pyranose rings directly oxidized into carboxyl groups.

The cellulose nanofibers modified with anionic functional groups introduced therein have a relatively high dispersibility. This is assumed to be because the anionic functional groups cause locally biased charge, and easily form hydrogen bonding with water or organic solvents in the dispersion.

When cellulose fibers are subjected to esterification with phosphorus oxoacid, which is an example of anionization, the raw material fibers may be made finer, and the resulting cellulose nanofibers have a higher aspect ratio, excellent strength, a higher light transmittance, and a higher viscosity. The esterification with phosphorus oxoacid may be performed by, for example, the technique disclosed in JP 2019-199671 A.

The esterification reaction with phosphorus oxoacid proceeds by adding, to cellulose fibers, a solution at lower than pH 3.0 of an additive containing at least one of phosphorus oxoacids and metal salts of phosphorus oxoacids, followed by heating.

The additive may be, for example, phosphoric acid, ammonium dihydrogen phosphate, diammonium hydrogen phosphate, triammonium phosphate, ammonium pyrophosphate, ammonium polyphosphate, lithium dihydrogen phosphate, trilithium phosphate, dilithium hydrogen phosphate, lithium pyrophosphate, lithium polyphosphate, sodium dihydrogen phosphate, disodium hydrogen phosphate, trisodium phosphate, sodium pyrophosphate, sodium polyphosphate, potassium dihydrogen phosphate, dipotassium hydrogen phosphate, tripotassium phosphate, potassium pyrophosphate, potassium polyphosphate, or a phosphorous acid compound such as phosphorous acid, sodium hydrogen phosphite, ammonium hydrogen phosphite, potassium hydrogen phosphite, sodium dihydrogen phosphite, sodium phosphite, lithium phosphite, potassium phosphite, magnesium phosphite, calcium phosphite, triethyl phosphite, triphenyl phosphite and pyrophosphorous acid. The additive may be one or a combination of a plurality of these. The phosphorus oxoacids are preferably partially or wholly phosphonic acids. With the phosphonic acids, the cellulose fibers are kept from yellowing, and the color of the resulting molded body is hardly affected.

Cellulose fibers have a structure wherein glucose is a structural unit and a plurality of glucose units are polymerized. In one polymerized cellulose fiber, the ester group of phosphorus oxoacid may substitute for a hydroxyl group in some glucose but not in some other glucose. Further, the ester group of phosphorus oxoacid may substitute for each of a plurality of hydroxyl groups in one glucose.

The cellulose nanofibers having cationic functional groups introduced therein through cationic treatment may be, for example, cellulose nanofibers into which groups having cations of ammonium (e.g., quaternary ammonium), phosphonium, sulfonium, or the like, are introduced, but not limited thereto.

The group having a cation may be introduced by, for example, reacting cellulose fibers and a reactant in a solvent in the presence of a catalyst. The introduction may be promoted at a reaction temperature of 10° C. or higher and 90° C. or lower, over a reaction time of 10 minutes or longer and 10 hours or shorter. The reactant may be glycidyl trimethyl ammonium chloride, 3-chloro-2-hydroxypropyl trialkyl ammonium hydride, or their halohydrins. The catalyst may be sodium hydroxide, potassium hydroxide, or the like. The solvent may be water or alcohol, which may be an alcohol having 4 or less carbon atoms.

The amount of the reactant may be preferably 5 mass % or more, more preferably 10 mass % or more, with respect to 100 mass % of cellulose fibers. The amount of the catalyst may be preferably 0.5 mass % or more, more preferably 1 mass % or more, with respect to 100 mass % of cellulose fibers.

The amount of cationic substituents introduced into the cellulose fibers may be adjusted by selection of the reactant, presence/absence of the catalyst, or the kind of the solvent. Per one structural unit glucose (e.g., a glucopyranose ring) of cellulose fibers, 0.01 to 0.4 cationic substituents may be introduced. Below this range, the effect from the introduction of cationic functional groups, i.e., easy defibration of the fibers, is insufficient. Above this range, the cellulose nanofibers may swell or dissolve excessively.

Defibration of cellulose fibers may be performed by means of the following defibration apparatus or method. That is, the defibration may be performed by employing one or more of the means selected and used from, for example, homogenizers, such as high-pressure homogenizers and high-pressure homogenizing apparatus, millstone friction machines, such as grinders and mills, refiners, such as conical refiners and disk refiners, and various bacteria. Defibration of cellulose fibers may preferably be performed by means of an apparatus and method where the fibers are made finer in water streams, in particular, high pressure water streams. By means of such an apparatus and method, significantly high dimensional uniformity and dispersion uniformity may be imparted to the resulting cellulose nanofibers. In contrast, by means of a grinder in which the fibers are ground between rotating grindstones, it is hard to uniformly make the cellulose fibers finer, and some fiber lumps may remain without loosened.

The grinder to be used in the defibration of cellulose fibers may be, for example, Masscolloider manufactured by MASUKO SANGYO CO., LTD. The apparatus for making the fiber finer in high-pressure water streams may be, for example, Star Burst (registered trademark) manufactured by SUGINO MACHINE LIMITED, or Nanovater (registered trademark) manufactured by YOSHIDA KIKAI CO., LTD. A high-speed rotary homogenizer that may be used in the defibration of cellulose fibers may be CLEARMIX-11S manufactured by M TECHNIQUE CO., LTD.

The present inventors have found out that the fibers obtained by defibrating cellulose fibers in high-pressure water streams have more uniform fiber widths, compared, by microscopic observation, to the fibers obtained by defibrating cellulose fibers by grinding between rotating grindstones.

The defibration in high-pressure water streams may preferably be performed by pressurizing a dispersion of cellulose fibers in a pressure booster up to, for example, 30 MPa or higher, preferably 100 MPa or higher, more preferably 150 MPa or higher, particularly preferably 220 MPa or higher (high pressure conditions), and jetting the dispersion through a nozzle with a pore diameter of 50 m or larger to release the pressure so that the pressure difference is, for example, 30 MPa or more, preferably 80 MPa or more, more preferably 90 MPa or more (reduced pressure conditions). Due to the cleavage phenomenon caused by the pressure difference, the pulp fibers are defibrated. With the pressure under the high pressure conditions being too low, or with the pressure difference between the high pressure conditions and the reduced pressure conditions being too small, the defibration efficiency is low, and repeated defibration (jetting through the nozzle) is required until the desired fiber width is achieved.

As the apparatus for defibration in high-pressure water streams, a high-pressure homogenizer is preferably used, which is a homogenizer capable of jetting a slurry of cellulose fibers at, for example, 10 MPa or higher, preferably 100 MPa or higher. By the treatment in a high-pressure homogenizer, the cellulose fibers are effectively defibrated through the actions of collision between cellulose fibers, pressure difference, microcavitation, or the like. In this way, the number of defibration treatments may be reduced to improve manufacturing efficiency of cellulose nanofibers.

The high-pressure homogenizer preferably causes colinear, countercurrent collision of streams of a cellulose fiber slurry. Specifically, such a high-pressure homogenizer may be, for example, a countercurrent high-pressure homogenizer, MICROFLUIDIZER (registered trademark) (wet jet mill). In this apparatus, two upstream channels are provided so that two streams of a pressurized cellulose fiber slurry undergo countercurrent collision in a joint chamber. The streams of the cellulose fiber slurry collide in the joint chamber, and then flow out through a downstream channel. The downstream channel is provided at right angles to the upstream channels, forming a T-junction together. In such a high-pressure homogenizer of countercurrent collision type, the energy provided by the high-pressure homogenizer is converted maximally to the collision energy to realize efficient defibration of cellulose fibers.

The cellulose nanofibers obtained through the defibration may be dispersed in an aqueous medium to prepare a dispersion, prior to mixing with the microfibrillated cellulose or pulp. The aqueous medium is particularly preferably water in its entirety (aqueous dispersion), but aqueous medium partly containing another liquid compatible with water may also be used. Such another liquid may be, for example, a lower alcohol having 3 or less carbon atoms.

The raw material pulp is preferably defibrated so that the physical properties of the resulting cellulose nanofibers correspond to the desired values or evaluations to be discussed below.

<Average Fiber Diameter>

The average fiber diameter of the cellulose nanofibers (average fiber width, or average diameter of single fibers) is 10 nm or larger, preferably 15 nm or larger, more preferably 20 nm or larger, and 100 nm or smaller, preferably 90 nm or smaller, more preferably 80 nm or smaller. With an average fiber diameter of the cellulose nanofibers of smaller than the minimum 10 nm, dewaterability of the wet sheet may be deteriorated. With an average fiber diameter of the cellulose nanofibers of the maximum 100 nm or smaller, the cellulose fibers have been sufficiently made finer, which results in the wet sheet to have a dense structure and excellent physical properties.

The fine cellulose fibers contained in the wet sheet may be cellulose nanofibers alone, microfibrillated cellulose alone, or both cellulose nanofibers and microfibrillated cellulose. Microfibrillated cellulose imparts superior dewaterability to the fine cellulose fibers than cellulose nanofibers. By adjusting the proportions of the cellulose nanofibers and the microfibrillated cellulose, desired dewaterability may be imparted to the wet sheet. When a relatively high dewaterability is to be imparted to the wet sheet, the proportion of the microfibrillated cellulose may be raised (in this case, the proportion of the cellulose nanofibers may be zero), whereas when a relatively low dewaterability is to be imparted, the proportion of the microfibrillated cellulose may be lowered (in this case, the proportion of the microfibrillated cellulose may be zero).

The average fiber diameter of cellulose nanofibers may be adjusted by, for example, selection, pretreatment, or defibration of the raw material pulp.

The average fiber diameter of the cellulose nanofibers is measured as follows.

First, 100 ml of an aqueous dispersion of the cellulose nanofibers having a solid concentration of 0.01 to 0.1 mass % is filtered through a TEFLON (registered trademark) membrane filter, and subjected to solvent substitution once with 100 ml of ethanol and three times with 20 ml of t-butanol. Then the resulting mass is lyophilized and coated with osmium to obtain a sample. An electron microscopic SEM image of this sample is observed at a magnification of 3000 to 30000 folds, depending on the width of the constituent fibers. Specifically, two diagonal lines are drawn on the observation image, and three arbitrary straight lines passing the intersection of the diagonals are drawn. Then, the widths of a total of 100 fibers crossing these three straight lines are visually measured. The median diameter obtained from the measured values is taken as the average fiber diameter.

<Average Fiber Length>

The average fiber length (average of lengths of single fibers) of the cellulose nanofibers is, for example, 0.3 to 2000 μm, preferably 0.4 to 200 μm, more preferably 0.5 to 20 μm. With an average fiber length of the cellulose nanofibers below 0.3 μm, the drainage and the drying property are poor, and the three-dimensional network structure among the cellulose nanofibers is hard to be formed, which may deteriorate the reinforcing effect. With an average fiber length over 2000 μm, the cellulose fibers are entangled too much to form a uniform three-dimensional network structure.

The average fiber length may be adjusted by, for example, selection, pretreatment, or defibration of the raw material pulp.

The average fiber length of the cellulose nanofibers may be determined in the same way as for the average fiber diameter, i.e., the length of each fiber is measured visually, and the median diameter of the measured values is taken as the average fiber length.

<Aspect Ratio>

In the production of a molded body or the like from the wet sheet, the strength of the molded body or the like is preferably improved, while the ductility is maintained to an extent. In this regard, the aspect ratio of the cellulose nanofibers is at least 3 or higher, preferably 6 or higher, more preferably 10 or higher, and 150000 or lower, preferably 120000 or lower, more preferably 100000 or lower. With an aspect ratio below 3, the cellulose nanofibers cannot be expected to have the properties as fibers. With an aspect ratio over 150000, the cellulose nanofibers may result in too viscous a cellulose fiber slurry, which makes production of the wet sheet difficult.

The aspect ratio refers to a value obtained by dividing the average fiber length by the average fiber width of the cellulose nanofibers. A larger aspect ratio causes a larger number of locations in the fibers to be caught, which enhances the reinforcing effect but, as such, is assumed to result in lower ductility of the molded body or the like.

<Pseudo Particle Size Distribution Curve>

The pseudo particle size distribution curve of the cellulose nanofibers preferably has one peak. With one peak, the cellulose nanofibers have high uniformity in fiber length and fiber diameter, are ready to form a dense three-dimensional structure, and may be produced into a molded body with excellent properties. The cellulose nanofibers may also be made into a cellulose fiber slurry having excellent drying property and dewaterability.

With the pseudo particle size distribution curve of the cellulose nanofibers having one peak, the smaller the variation (distribution) in fiber lengths and/or fiber diameters of the cellulose nanofibers, the more easily the three-dimensional network structure is formed, which is preferable. When the pseudo particle size distribution curve of the cellulose nanofibers has one peak, the half width of this peak is, for example, 250 μm or less, preferably 200 μm or less, particularly preferably 150 μm. With the half width of the peak exceeding 250 μm, the cellulose fibers may not have been made sufficiently finer, and the resulting molded body may not form a dense three-dimensional network structure to result in possible deterioration of its properties. The half width of the peak may be caused to be 250 μm or less by, for example, increasing the number of times of the treatment to make the fibers finer.

The particle size of the cellulose nanofibers at the peak may be, for example, 1 μm or larger, preferably 3 μm or larger, more preferably 5 μm or larger. With a particle size at the peak below 1 μm, the fibers may have been defibrated excessively, which leads to inferior drainage or drying property of the wet sheet or the molded body or the like.

The particle size of the cellulose nanofibers at the peak may be, for example, 100 μm or smaller, preferably 80 μm or smaller, more preferably 60 μm or smaller. With a particle size at the peak over 100 μm, the fibers may not have been defibrated sufficiently, which leads to inferior uniformity in fiber diameter or fiber length.

The peak value of the pseudo particle size distribution curve of the cellulose nanofibers is determined in accordance with ISO-13320 (2009). For example, a volume-based particle size distribution of an aqueous dispersion of the cellulose nanofibers is determined using a particle size distribution measuring device (laser diffraction/scattering-type particle size distribution measuring apparatus manufactured by SEISHIN ENTERPRISE CO., LTD.). From the obtained distribution, the median diameter of the cellulose nanofibers is determined. This median diameter is taken as the peak value.

The peak value of the pseudo particle size distribution curve of the cellulose nanofibers and the median diameter of the distribution may be adjusted by, for example, selection, pretreatment, or defibration of the raw material pulp.

<Pulp Viscosity>

The pulp viscosity of the defibrated cellulose nanofibers is preferably 1 cP or higher, more preferably 2 cP or higher. At a pulp viscosity below 1 cP, aggregation of the cellulose nanofibers may not be controlled sufficiently.

<B-Type Viscosity>

The defibrated cellulose nanofibers may be mixed with water to prepare an aqueous dispersion. This aqueous dispersion of the cellulose nanofibers has a viscosity, which may be evaluated in terms of B-type viscosity. B-type viscosity differs depending on the concentration of the cellulose nanofibers, even between dispersions prepared from the particular raw material through the same production process. The higher the concentration, the higher the viscosity is. The B-type viscosity of an aqueous dispersion of the cellulose nanofibers (at 1% (w/w) solid concentration) is preferably 10 to 4000 cP, more preferably 80 to 3000 cP, particularly preferably 100 to 2000 cP. An aqueous dispersion at a B-type viscosity below 10 cP has poor dispersibility of the cellulose nanofibers, and may not mix sufficiently with the microfibrillated cellulose or the pulp when mixed together. An aqueous dispersion at a B-type viscosity over 4000 cP, when mixed with the microfibrillated cellulose and the pulp, may result in a slurry or a wet sheet having poor dewaterability.

The B-type viscosity of a dispersion of cellulose nanofibers (at 1% (w/w) solid concentration) is a value determined in accordance with JIS-Z8803 (2011) "Method for Viscosity Measurement of Liquid". B-type viscosity is resistant torque in stirring a dispersion, and a higher value indicates more energy required for stirring. The B-type viscosity is measured at 25° C.

<Degree of Crystallinity>

The degree of crystallinity of the cellulose nanofibers is preferably 50% or higher, more preferably 55% or higher, particularly preferably 60% or higher. At a degree of crystallinity below 50%, the strength and the heat resistance of the molded body may be insufficient.

On the other hand, the degree of crystallinity of the cellulose nanofibers is preferably 100% or lower, more preferably 90% or lower, particularly preferably 85% or lower. With the degree of crystallinity within the above-mentioned range, strength is ensured in the process of manufacturing a wet sheet, a molded body or the like from a slurry of the cellulose fibers.

The degree of crystallinity of the cellulose nanofibers may arbitrarily be adjusted by, for example, selection, pretreatment, or making finer of the raw material pulp.

The degree of crystallinity refers to a value determined by X-ray diffraction in accordance with JIS K 0131 (1996) "General Rules for X-ray Diffraction Analysis". Note that cellulose nanofibers have amorphous regions and crystalline regions, and the degree of crystallinity refers to the ratio of the crystalline regions with respect to the entire cellulose nanofibers.

<Water Retention>

The water retention of the cellulose nanofibers is, for example, 90 to 600%, preferably 200 to 500%, more preferably 240 to 460%. With a water retention below 90%, the cellulose nanofibers may have a poor dispersibility, and may not mix well with the microfibrillated cellulose or the pulp. With a water retention over 600%, the cellulose nanofibers may result in a slurry with poor drainage and drying property.

The water retention of the cellulose nanofibers may arbitrarily be adjusted by, for example, selection, pretreatment, or defibration of the raw material pulp.

The water retention of the cellulose nanofibers refers to a value determined in accordance with JAPAN TAPPI No. 26 (2000).

The content of the cellulose nanofibers in the wet sheet (solid concentration) is, for example, 0 to 39.6 mass %, preferably 10 to 38 mass %, more preferably 12 to 36 mass %. With a content within the range, the cellulose nanofibers are adequately dispersed in the wet sheet, which is preferable. Further, when the wet sheet is made into a molded body or the like, the cellulose nanofibers are adequately dispersed in the molded body or the like. With a content over 39.6 mass %, drainage and drying property may not be good enough.

<Microfibrillated Cellulose>

Next, the microfibrillated cellulose contained in the wet sheet is discussed below. Microfibrillated cellulose has a large number of hydrogen bonding points of cellulose fibers, has dewaterability, and disperses when mixed in a media, such as water or organic solvents. Microfibrillated cellulose may be prepared by defibrating raw material pulp, and has an average fiber diameter larger than that of cellulose nanofibers.

The microfibrillated cellulose may be obtained by defibrating (making finer) raw material pulp derived from plant. As the raw material pulp for microfibrillated cellulose, one or more members may be selected and used from the group consisting of, for example, wood pulp made from hardwood, softwood, or the like; non-wood pulp made from straw, bagasse, cotton, hemp, bast fibers, or the like; and de-inked pulp (DIP) made from brown waste paper, envelope waste paper, magazine waste paper, leaflet waste paper, corrugated waste paper, hard white waste paper, simili waste paper, ground wood waste paper, recovered used paper, waste paper, or the like. These various raw materials may be in the form of a ground product, such as those referred to as cellulose-based powder.

In this regard, however, the raw material pulp is preferably wood pulp in order to avoid contamination of impurities as much as possible. As the wood pulp, one or more members may be selected and used from the group consisting of, for example, chemical pulp, such as hardwood kraft pulp (LKP) and softwood kraft pulp (NKP), and mechanical pulp (TMP).

The hardwood kraft pulp may be hardwood bleached kraft pulp, hardwood unbleached kraft pulp, or hardwood semi-bleached kraft pulp. Similarly, the softwood kraft pulp may be softwood bleached kraft pulp, softwood unbleached kraft pulp, or softwood semi-bleached kraft pulp.

As the mechanical pulp, one or more members may be selected and used from the group consisting of, for example, stone ground pulp (SGP), pressurized stone ground pulp (PGW), refiner ground pulp (RGP), chemi-ground pulp (CGP), thermo-ground pulp (TGP), ground pulp (GP), thermomechanical pulp (TMP), chemithermomechanical pulp (CTMP), refiner mechanical pulp (RMP), and bleached thermomechanical pulp (BTMP).

For production of the wet sheet and the molded body, preferably chemical pulp, more preferably LKP and NKP may be used for imparting a higher strength.

The technique for defibrating raw material pulp into the cellulose nanofibers discussed above may be applied to defibration of the raw material pulp into the microfibrillated cellulose. However, the defibration into the microfibrillated cellulose does not aim to make the average fiber diameter as small as that of the cellulose nanofibers.

The microfibrillated cellulose obtained through the defibration may be dispersed in an aqueous medium to prepare a dispersion, prior to mixing with the cellulose nanofibers or the pulp. The aqueous medium is particularly preferably water in its entirety (aqueous dispersion), but aqueous medium partly containing another liquid compatible with water may also be used. Such another liquid may be, for example, a lower alcohol having 3 or less carbon atoms.

The raw material pulp is preferably defibrated so that the physical properties of the resulting microfibrillated cellulose correspond to the desired values or evaluations to be discussed below. Various physical properties of the microfibrillated cellulose may be measured in the same way as for the cellulose nanofibers or the pulp, unless otherwise described herein.

<Average Fiber Diameter>

The average fiber diameter of the microfibrillated cellulose (average fiber width, or average diameter of single fibers) is over 100 nm, preferably 200 nm or larger, more preferably 300 nm or larger. The average fiber diameter of the microfibrillated cellulose is 10000 nm or smaller, preferably 5000 nm or smaller, more preferably 3000 nm or smaller. With an average fiber diameter of 100 nm or smaller, the microfibrillated cellulose may deteriorate dewaterability of the wet sheet, and may be hard to be distinguished from the cellulose nanofibers, which should be avoided. With an average fiber diameter over the maximum 10000 nm, the cellulose fibers may not have been made sufficiently finer.

The average fiber diameter of the microfibrillated cellulose may be adjusted by, for example, selection, pretreatment, or defibration of the raw material pulp.

The average fiber diameter of the microfibrillated cellulose is measured as follows.

First, 100 ml of an aqueous dispersion of the microfibrillated cellulose having a solid concentration of 0.01 to 0.1 mass % is filtered through a TEFLON (registered trademark) membrane filter, and subjected to solvent substitution once with 100 ml of ethanol and three times with 20 ml of t-butanol. Then the resulting mass is lyophilized and coated with osmium to obtain a sample. An electron microscopic SEM image of this sample is observed at a magnification of 3000 to 30000 folds, depending on the width of the constituent fibers. Specifically, two diagonal lines are drawn on the observation image, and three arbitrary straight lines passing the intersection of the diagonals are drawn. Then, the widths of a total of 100 fibers crossing these three straight lines are visually measured. The median diameter of the measured values is taken as the average fiber diameter.

<Average Fiber Length>

The average fiber length (average of lengths of single fibers) of the microfibrillated cellulose is, for example, 10 to 1000 μm, preferably 30 to 700 μm, more preferably 50 to 500 μm. With an average fiber length of the microfibrillated cellulose below 30 μm, the drainage and the drying property are poor, and the reinforcing effect of the resulting wet sheet or the molded body or the like may be deteriorated. With an average fiber length above 1000 μm, the cellulose fibers are entangled so much as to lower the dispersibility.

The average fiber length may arbitrarily be adjusted by, for example, selection, pretreatment, or defibration of the raw material pulp.

The average fiber length of the microfibrillated cellulose may be determined in the same way as for the average fiber diameter, i.e., the length of each fiber is measured visually, and the median diameter obtained from the measured values is taken as the average fiber length.

<Aspect Ratio>

In the production of a molded body or the like from the wet sheet, the strength of the molded body or the like is preferably improved, while the ductility is maintained to an extent. In this regard, the aspect ratio of the microfibrillated cellulose is 3 or higher, preferably 5 or higher, more preferably 10 or higher, and 10000 or lower, preferably 7000 or lower, more preferably 5000 or lower. With an aspect ratio below 3, the microfibrillated cellulose cannot be expected to have the properties as fibers. With an aspect ratio over 10000, the microfibrillated cellulose may result in too viscous a cellulose fiber slurry, which makes production of the wet sheet difficult.

The aspect ratio refers to a value obtained by dividing the average fiber length by the average fiber width of the microfibrillated cellulose. A larger aspect ratio causes a larger number of locations in the fibers to be caught, which enhances the reinforcing effect but, as such, is assumed to result in lower ductility of the molded body or the like.

<Pseudo Particle Size Distribution Curve>

The pseudo particle size distribution curve of the microfibrillated cellulose preferably has one peak. With one peak, the microfibrillated cellulose has high uniformity in fiber length and fiber diameter, is ready to form a dense three-dimensional structure, and may be produced into a molded body with excellent properties. The microfibrillated cellulose may also be made into a cellulose fiber slurry having excellent drying property and dewaterability.

With the pseudo particle size distribution curve of the microfibrillated cellulose having one peak, the smaller the variation (distribution) in fiber lengths and/or fiber diameters of the microfibrillated cellulose, the more easily the three-dimensional network structure is formed, which is preferable. When the pseudo particle size distribution curve of the microfibrillated cellulose has one peak, the half width of this peak is, for example, 250 m or less, preferably 200 μm or less, particularly preferably 150 μm. With the half width of the peak exceeding 250 μm, the microfibrillated cellulose may not have been made sufficiently fine, and the molded body may not form a dense three-dimensional network structure to result in possible deterioration of its properties. The half width of the peak may be caused to be 150 μm or less by, for example, increasing the number of times of the treatment to make the fibers finer.

The particle size of the microfibrillated cellulose at the peak may be, for example, 1 μm or larger, preferably m or larger, more preferably 10 μm or larger. With a particle size at the peak below 1 μm, the fibers may have been defibrated excessively, which leads to inferior drainage or drying property of the wet sheet or the molded body or the like.

The particle size of the microfibrillated cellulose at the peak may be, for example, 110 μm or smaller, preferably 100 μm or smaller, more preferably 90 μm or smaller. With a particle size at the peak over 110 μm, the fibers may not have been defibrated sufficiently, which leads to inferior uniformity in fiber diameter or fiber length.

The peak value of the pseudo particle size distribution curve of the microfibrillated cellulose is determined in accordance with ISO-13320 (2009). For example, a volume-based particle size distribution of an aqueous dispersion of the microfibrillated cellulose is determined using a particle size distribution measuring device (laser diffraction/scattering-type particle size distribution measuring apparatus manufactured by SEISHIN ENTERPRISE CO., LTD.). From the obtained distribution, the median diameter of the microfibrillated cellulose is determined. This median diameter is taken as the peak value.

The peak value of the pseudo particle size distribution curve of the microfibrillated cellulose and the median diameter of the distribution may be adjusted by, for example, selection, pretreatment, or defibration of the raw material pulp.

<Pulp Viscosity>

The pulp viscosity of the defibrated microfibrillated cellulose is preferably 1 cP or higher, more preferably 2 cP or higher. At a pulp viscosity below 1 cP, aggregation of the microfibrillated cellulose may not be controlled sufficiently.

<Degree of Crystallinity>

The degree of crystallinity of the microfibrillated cellulose is preferably 45% or higher, more preferably 55% or higher, particularly preferably 60% or higher. At a degree of crystallinity below 45%, the strength and the heat resistance of the molded body may be insufficient.

On the other hand, the degree of crystallinity of the microfibrillated cellulose is preferably 90% or lower, more preferably 88% or lower, particularly preferably 86% or lower. With the degree of crystallinity within the above-mentioned range, strength is ensured in the process of manufacturing a wet sheet, a molded body or the like from a slurry of the cellulose fibers.

The degree of crystallinity of the microfibrillated cellulose may arbitrarily be adjusted by, for example, selection, pretreatment, or making finer of the raw material pulp.

The degree of crystallinity refers to a value determined by X-ray diffraction in accordance with JIS K 0131 (1996)

"General Rules for X-ray Diffraction Analysis". Note that microfibrillated cellulose has amorphous regions and crystalline regions, and the degree of crystallinity refers to the ratio of the crystalline regions with respect to the entire microfibrillated cellulose.

<Water Retention>

The water retention of the microfibrillated cellulose is, for example, 10 to 500%, preferably 50 to 450%, more preferably 90 to 400%. With a water retention below 10%, the microfibrillated cellulose may have a poor dispersibility, and do not mix well with the cellulose nanofiber or the pulp. With a water retention over 500%, the microfibrillated cellulose may result in a slurry with poor drainage and drying property.

The water retention of the microfibrillated cellulose may arbitrarily be adjusted by, for example, selection, pretreatment, or defibration of the raw material pulp.

The water retention of the microfibrillated cellulose refers to a value determined in accordance with JAPAN TAPPI No. 26 (2000).

The percentage of fibrillation of the microfibrillated cellulose is preferably 0.5% or higher, more preferably 1.0% or higher, particularly preferably 1.5% or higher. The percentage of fibrillation is preferably 10% or lower, more preferably 9% or lower, particularly preferably 8% or lower. At a percentage of fibrillation over 10%, the microfibrillated cellulose has too large an area of contact with water, which may cause difficulties in dewatering. At a percentage of fibrillation below 0.5%, the microfibrillated cellulose has too few hydrogen bonding between the fibrils to form a strong three-dimensional network structure.

The freeness of the microfibrillated cellulose is preferably 200 ml or less, more preferably 150 ml or less, particularly preferably 100 ml or less. With a freeness over 200 ml, the microfibrillated cellulose has an average fiber diameter over the maximum 10 μm, and may not produce sufficient effect regarding strength.

The freeness of the microfibrillated cellulose is a value determined in accordance with JIS P8121-2 (2012).

<Proportion>

The content of the microfibrillated cellulose in the wet sheet (solid concentration) is, for example, 0 to 39.6 mass %, preferably 10 to 38 mass %, more preferably 12 to 36 mass %. At a content within this range, the microfibrillated cellulose is adequately dispersed in the wet sheet, which is preferable. Further, when the wet sheet is made into a molded body or the like, the microfibrillated cellulose is adequately dispersed in the molded body or the like. With a content over 39.6 mass %, drainage and drying property may not be good enough.

<Wet Sheet>

The wet sheet is manufactured from a cellulose fiber slurry wherein at least either of the cellulose nanofibers and the microfibrillated cellulose are mixed with pulp. The production method of the wet sheet will be discussed later.

A conventional CNF molded body as disclosed in, e.g., Japanese Patent Application No. 2017-190529, is in the form of a planar sheet. Deformation processing of this CNF molded body into a molded body of a desired three-dimensional shape had the following problems. As the CNF molded body in a dried state was difficult to be deformation-processed into a molded body of a three-dimensional shape, the CNF molded body was impregnated with water to soften, and the softened CNF molded body was deformed. In this process, the step of re-drying the deformed CNF molded body was additionally required, which deteriorates productivity and increases production cost.

In contrast, the wet sheet according to the present embodiment is easy to deform while having a shape, capable of temporarily retaining a desired shape, and is useful as a material for molded bodies of various three-dimensional shapes. Various properties of the wet sheet are discussed below.

The water content of the wet sheet may be 60 mass % or higher, more preferably 63 mass % or higher, still more preferably 65 mass % or higher. At a water content below 60 mass %, the wet sheet has a lowered flexibility, which makes it difficult to be produced into a molded body of a desired shape. The upper limit of the water content is not particularly limited, and may be 90 mass % or lower for controlling unevenness in thickness which is likely to occur in the molded body upon production, to produce a molded body with uniform strength.

The water content of the wet sheet may be determined in accordance with JIS P 8203 (2010).

The thickness of the wet sheet is preferably 0.5 mm or more, more preferably 0.8 mm or more, still more preferably 1 mm or more, and preferably 10 mm or less, more preferably 9 mm or less, still more preferably 8 mm or less. With a thickness below 0.5 mm, the wet sheet may be prone to be torn. With a thickness over 10 mm, the wet sheet may likely be made, by applying pressure and heat, into a molded body with uneven thickness.

Further, the wet sheet preferably has a thickness of 0.5 mm or more and 10 mm or less, and a water content of 60 mass % or more. With a thickness of 0.5 mm or more and 10 mm or less, but with a water content below 60 mass %, the wet sheet may hardly be flexed or folded, which makes it difficult to form a molded body of a three-dimensional shape.

The thickness of the wet sheet may be determined in accordance with JIS P 8118 (2014).

The rate of thickness change represents the degree of compressibility of the wet sheet in its thickness direction. A lower value represents hardness of the wet sheet to be compressed, which means that the wet sheet may be made by heating and pressing into a molded body with less unevenness in thickness and hard to be fractured. A wet sheet with a higher rate of thickness change is more easily compressed and is deformable when heated and pressurized, so that the resulting molded body is prone to fracture.

The rate of thickness change may be calculated in accordance with formula (1) below:

Rate of thickness change=((thickness of wet sheet after application of pressure at 100 kPa for 1 second in thickness direction)−(thickness of wet sheet after application of pressure at 100 kPa for 5 seconds in thickness direction))/(thickness of wet sheet after application of pressure at 100 kPa for 1 second in thickness direction). Formula (1):

The rate of thickness change may suitably be adjusted, and may be preferably 0.4 or lower, more preferably 0.35 or lower, still more preferably 0.3 or lower, at which the wet sheet has little unevenness in thickness and is hard to fracture.

The rate of thickness change may be determined as follows. The wet sheet is covered with a film on each side, a pressure at 100 kPa is applied in the thickness direction for 1 second, and the thickness of the wet sheet is measured. Further, a pressure at 100 kPa is applied in the thickness direction for 5 seconds, and the thickness of the wet sheet is measured. The measurements may be made under atmospheric pressure at room temperature (5 to 30° C., in particular 25° C., 1 atm)

<Proportion>

The proportions of the pulp and the fine cellulose fibers in the wet sheet may be, for example, 1:99 to 50:50, preferably 5:95 to 30:70, more preferably 10:90 to 20:80.

The proportions of the cellulose nanofibers and the microfibrillated cellulose may be, for example, 100:0 to 0:100, preferably 80:20 to 20:80, more preferably 70:30 to 30:70.

<Water Retention Capacity>

The wet sheet, when dispersed in an aqueous medium at 1.5% concentration, has a water retention capacity of preferably 250 to 4000 g/m$^2$, more preferably 500 to 3000 g/m$^2$. With a water retention capacity below 250 g/m$^2$, the wet sheet has poor wettability, whereas with a water retention capacity over 4000 g/m$^2$, the wet sheet may not be able to maintain its shape.

<Density>

The wet sheet, when dewatered and dried at 1 to 50 MPa at 100 to 150° C. to increase its density and molded into a molded body, has a density of preferably 0.8 to 1.5 g/m$^3$, more preferably 0.9 to 1.4 g/m$^3$, particularly preferably 1.0 to 1.3 g/m$^3$. At a density below 0.8 g/m$^3$, the wet sheet may be prone to fracture in the course of shaping into a molded body, whereas at a density over 1.5 g/m$^3$, the wet sheet may be hard to be handled.

The solid concentration of the fine cellulose fibers in the wet sheet may be over 0 mass %, preferably 10 mass % or more, more preferably 11 mass % or more, still more preferably 12 mass % or more, so that a higher strength is imparted to the resulting molded body. Further, the upper limit of the concentration of the fine cellulose fibers in the wet sheet is not particularly limited and, in view of the co-existence of pulp, may be preferably 39.6 mass % or less, more preferably 38 mass % or less in terms of solid concentration.

<Method for Producing Wet Sheet>

Next, a method for producing the wet sheet and the molded body is discussed. The method is composed of a preparation step 10 of preparing a slurry, a shaping step 20 of shaping a wet sheet, and a heating and pressurizing step 30 of applying heat and pressure to the wet sheet. These steps will now be discussed in turn.

<Preparation Step>

FIG. 2 illustrates an example of step 10 of preparing a slurry, wherein pulp P and fine cellulose fibers (cellulose nanofibers C and/or microfibrillated cellulose M) are mixed in an aqueous medium W to prepare a slurry S.

The solid concentration of the cellulose fibers (i.e., the total amount of the pulp P and the fine cellulose fibers) in the slurry is preferably 1.0 to 10.0 mass %, more preferably 1.2 to 7.0 mass %, particularly preferably 1.4 to 5.0 mass %. At a solid concentration below 1.0 mass %, the slurry has too high a fluidity, so that the cellulose fibers may flow out in the subsequent shaping step 20.

On the other hand, with a solid concentration of the cellulose fibers over 10.0 mass % (i.e., the total amount of the pulp P and the fine cellulose fibers), the slurry has a significantly lowered fluidity and thus a deteriorated processibility, so that, for example, the thickness of the wet sheet is likely to become uneven during the production, and a homogenous wet sheet may be hard to be obtained.

The medium, such as water (aqueous medium) W is preferably water in its entirety, but may partly contain another liquid compatible with water. Such other liquid may be, for example, a lower alcohol having 3 or less carbon atoms or a ketone having 5 or less carbon atoms.

The slurry of the cellulose fibers may preferably be caused to have a water retention capacity of preferably 250 to 4000 g/m$^2$, more preferably 500 to 3000 g/m$^2$, by properly adjusting its pulp content. The slurry is more easily dewatered at a higher water retention capacity, but with a water retention capacity over 4000 g/m$^2$, the slurry has a lowered dispersibility, and the resulting molded body is hard to be homogeneous. With a water retention capacity below 250 g/m$^2$, the slurry is not sufficiently dewatered in the dewatering step, or requires a prolonged time for dewatering, which deteriorate the productivity.

The water retention capacity of the slurry of the cellulose fibers is a value determined in accordance with TAPPI T701pm-01 (2001). The procedure of the determination is as follows: (1) place a PCTE filter on a filter paper for determination of water retention capacity (weigh its dry weight in advance), (2) place and hold (1) between the dedicated jigs and introduce a measurement sample (slurry), (3) make measurement (treat) under the conditions to be discussed later, (4) detach the PCTE filter from the filter paper and re-weigh the filter paper, and (5) calculate the water retention capacity by formula (2) below. The measurement was made under the conditions that a slurry of the cellulose fibers (at a concentration of 1.5 mass %, at 30° C.) was introduced into AA-GWR Water Retention Meter manufactured by KALTEC SCIENTIFIC SUPPLIES & INSTRUMENTS LLC, and measured under an air pressure of 1.5 kgf/cm$^2$ for 30 seconds.

$$\text{Water retention capacity (g/m}^2\text{)} = (\text{Weight of filter paper after dewatering} - \text{dry weight of filter paper}) \times 1250 \quad \text{Formula (2):}$$

<Shaping Step>

The slurry of cellulose fibers thus prepared is, in shaping step 20, held between two facing net sheets, and pressurized to dewater, to thereby shape the slurry into a wet sheet. In the shaping step 20, referring to FIG. 1, in a cylindrical formwork 13 placed on a table, a net sheet 12 is placed at the bottom, the slurry 11 is poured thereon, and a net sheet 14 is placed on the poured slurry 11 from above. With a formwork 13 made of a porous material, dewatering is promoted to reduce the time spent in step 20 of shaping the wet sheet.

The slurry 11 is dewatered by its own weight or under a relatively small pressure. Then the pressure 19 applied to the slurry may be increased stepwise or continuously. In this process, the water in the slurry 11 flows out through the net sheets 12, 14. The pressure 19 initially applied in this step is very small, and thus the slurry 11 is maintained at a high viscosity, and outflow of the fine cellulose fibers may be withheld. On the other hand, as the dewatering proceeds, the concentration of the slurry 11 increases and the fluidity decreases, so that the fine cellulose fibers are hard to flow out even when a larger pressure 9 is applied to the slurry 11.

In the shaping step 20, it is preferred to initially apply a pressure 19 of 2.5 kPa or lower. If a pressure over 2.5 kPa is initially applied, outflow of the fine cellulose fibers from the slurry 11 may be likely to occur. Net sheets having smaller meshes may control the outflow of the fine cellulose fibers, even when a pressure over 2.5 kPa is initially applied. In this case, however, the overall dewatering efficiency may be decreased. The initial pressure may substantially be atmospheric pressure, or the pressure of only the own weight of the net sheet 14.

After the slurry is dewatered to a certain degree by the initial pressurization, the pressure 19 may be started to increase. The pressure 19 is gradually increased up to the eventual pressure of 50 kPa or higher, preferably 100 kPa or higher, more preferably 200 kPa or higher.

After a pressure of 50 kPa or higher is applied to the slurry 11 for 10 minutes or longer, the formwork 13 is removed, and the wet sheet is obtained.

<Heating and Pressurizing Step>

In the heating and pressurizing step 30, the slurry is dewatered and dried at 1 to 50 MPa at 100 to 150° C. to increase its density, to thereby obtain a molded body X.

The molded body X thus obtained has a density of preferably 0.8 to 1.5 g/m$^3$, more preferably 0.9 to 1.4 g/m$^3$, particularly preferably 1.0 to 1.3 g/m$^3$. At a density below 0.8 g/m$^3$, the molded body X may be regarded as having insufficient strength because of the reduced number of hydrogen bonding points.

The density of the molded body X is a value determined in accordance with JIS P 8118: 1998.

The slurry S of the cellulose fibers may also contain additives, such as antioxidants, corrosion inhibitors, light stabilizers, ultraviolet absorbers, heat stabilizers, dispersants, defoamers, slime control agents, or preservatives, as required.

The wet sheet according to the present embodiment may be used as a material for a molded body having a three-dimensional shape.

EXAMPLES

Examples of the present invention will now be discussed.

(1) First, as cellulose fibers, a raw material pulp (hardwood bleached kraft pulp (LBKP), 97 mass % moisture percentage) and cellulose nanofibers (LBKP, 97 mass % moisture percentage) were mixed, and a cellulose fiber slurry having a solid concentration of 3 mass % of the LBKP cellulose nanofibers was prepared. The LBKP cellulose nanofibers had been prepared by pre-beating the raw material pulp (97 mass % moisture percentage) in a refiner and defibrating the resulting mass in a high-pressure homogenizer. The LBKP cellulose nanofibers were in the form of a 3 mass % aqueous dispersion in terms of solid, and had an average fiber diameter of 30 nm and a degree of crystallinity of 75%. This aqueous dispersion of the LBKP cellulose nanofibers and pulp were mixed in a stirring machine, and the resulting mixture was centrifuged (refrigerated centrifuge CR22N manufactured by HITACHI) at 8500 rpm for 10 minutes to obtain a concentrated mixture, which had a solid concentration of 5 mass % of the LBKP cellulose nanofibers. To this concentrated mixture, the aqueous dispersion of LBKP cellulose nanofibers and a dilution water were added, stirred and defoamed in a planetary centrifugal mixer (AWATORI RENTAROU (THINKY MIXER)) at 2000 rpm for 3 minutes to obtain a slurry of 5 mass % solid concentration.

(2) The slurry obtained from (1) was applied over a 300-mesh wire mesh (lower mesh), and another 300-mesh wire mesh (upper mesh) was placed on the slurry from above, to obtain a stack of the wire mesh, the slurry, and the wire mesh.

(3) Pressure was applied to the slurry held between the upper and lower wire meshes to obtain a wet sheet. Here, the stack was placed on a support table with the lower wire mesh downward and the upper wire mesh upward. A wet sheet obtained by placing a 5 kg weight on the upper wire mesh for 10 seconds was referred to as Test Example 1, a wet sheet obtained by placing a 5 kg weight on the upper wire mesh for 5 minutes was referred to as Test Example 2, and a wet sheet obtained by applying a pressure at 0.41 MPa to the upper wire mesh toward the lower wire mesh for 5 minutes was referred to as Test Example 3. Each of the wet sheets (Test Examples 1 to 3) was cut into a specimen of 10 cm long, 10 cm wide, and 0.2 cm thick.

(4) Each specimen of the wet sheets (Test Examples 1 to 3) was covered over the both sides with a resin film of 0.04 mm thick to obtain a covered product. Each covered product was placed on a support table, and a pressure at 100 kPa was applied to the covered product in its thickness direction for 1 second, and the thickness was measured. Similarly, a pressure at 100 kPa was applied to the covered product in its thickness direction for 5 seconds, the thickness was measured, and the rate of thickness change was determined.

(5) Further, the solid concentration (mass %) of the LBKP cellulose nanofibers in each of Test Examples 1 to 3 was determined.

The results of the above are shown in Table 1.

TABLE 1

| | Rate of thickness change | Solid concentration of LBKP cellulose nanofibers (mass %) |
|---|---|---|
| Test Example 1 | 0.5 | 7 |
| Test Example 2 | 0.32 | 10 |
| Test Example 3 | 0.01 | 25 |

MISCELLANEOUS

JIS, TAPPI, and other test and measurement methods discussed above are performed at room temperature, in particular 25° C., under atmospheric pressure, in particular at 1 atm, unless otherwise described herein.

INDUSTRIAL APPLICABILITY

The present invention is applicable as a molded body of cellulose fibers and a method for producing the same.

DESCRIPTION OF REFERENCE NUMERAL

10: Preparation step
20: Shaping step of shaping wet sheet
30: Heating and pressurizing step
S: Slurry
P: Pulp
W: Medium, like water
X: Molded body

The invention claimed is:

1. A method for producing a molded body, comprising:

preparing a slurry by mixing cellulosic pulp having an average fiber diameter of over 10 μm and 100 μm or smaller, and fine cellulose fibers having an average fiber diameter of 10 μm or smaller, shaping the slurry into a wet sheet by holding the slurry between two facing net sheets and applying pressure to the slurry to dewater, and applying heat and pressure to the wet sheet to obtain a molded body, wherein the wet sheet has a water content of 60 mass % or higher and a thickness of 0.5 mm or more and 10 mm or less, wherein a content of the fine cellulose fibers in the wet sheet (solid concentration) is 10 to 38 mass %, and wherein a rate of thickness change of the wet sheet determined by formula 1 is 0.4 or lower:

Rate of thickness change=((Thickness of wet sheet after application of pressure at 100 kPa in thickness direction for 1 second)−(Thickness of wet sheet after application of pressure at 100 kPa in thickness direction for 5 seconds))/ (Thickness of wet sheet after application of pressure at 100 kPa in thickness direction for 1 second) Formula 1.

2. The method for producing a molded body according to claim 1, wherein the shaping in the wet sheet is carried out substantially without heating.

3. The method for producing a molded body according to claim 1, wherein the fine cellulose fibers are at least either of cellulose nanofibers and microfibrillated cellulose having a larger average fiber diameter than that of the cellulose nanofibers.

* * * * *